US006102264A

United States Patent [19]

Redzisz

[11] Patent Number: 6,102,264

[45] Date of Patent: Aug. 15, 2000

[54] TOOL HOLDER FOR A TOOL BELT

[75] Inventor: Andrzej M. Redzisz, Skokie, Ill.

[73] Assignee: Travel Caddy, Inc., Des Plaines, Ill.

[21] Appl. No.: 09/177,280

[22] Filed: Oct. 22, 1998

[51] Int. Cl.[7] ..... A45F 5/00

[52] U.S. Cl. ..... 224/197; 224/251; 224/904

[58] Field of Search ..... 224/904, 251, 224/197; D3/228

[56] References Cited

U.S. PATENT DOCUMENTS 4,106,679 8/1978 Hillinger ..... 224/197
4,372,468 2/1983 Harvey ..... 224/904
4,790,461 12/1988 Stover ..... 224/904

*Primary Examiner*—Linda J. Scholl
*Attorney, Agent, or Firm*—Banner & Witcoff

[57] ABSTRACT

An improved tool holder includes a closed loop comprised of a rod with spaced ends and a bridging element between the spaced ends. The loop typically is closed with the head of the tool retained by the loop and handle fitting through the loop. The handle of the tool may, however, be pivoted to release the bridging section from closing the loop thereby enabling the tool to be removed from the loop. Typically, the holder is mounted on the tool belt and provides a very inexpensive, yet highly reliable manner and construction for maintaining the tool in position ready for use, yet safely retained.

10 Claims, 4 Drawing Sheets

FIG.8
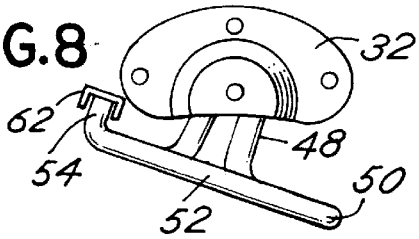
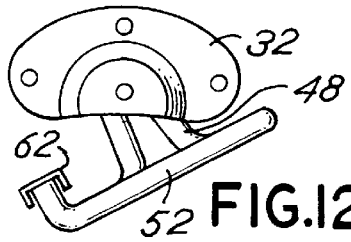
FIG.12
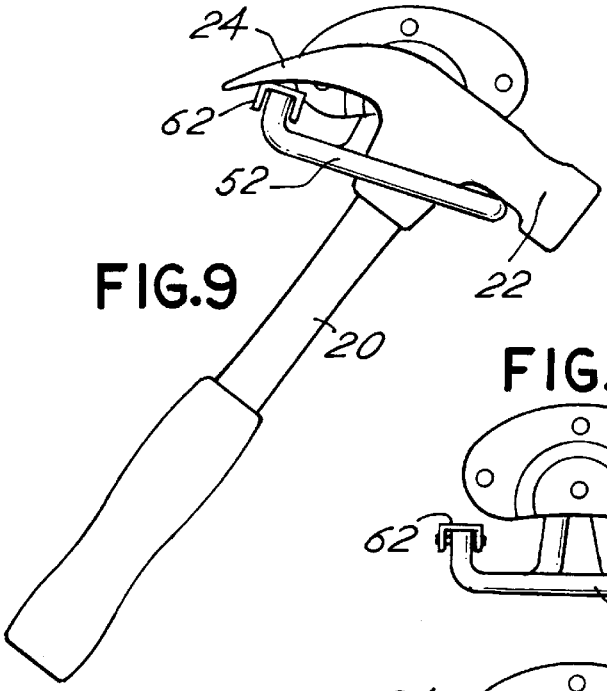
FIG.9
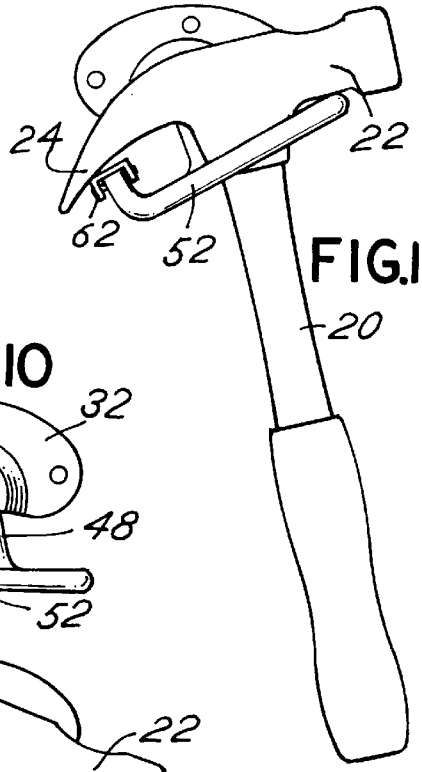
FIG.13
FIG.10
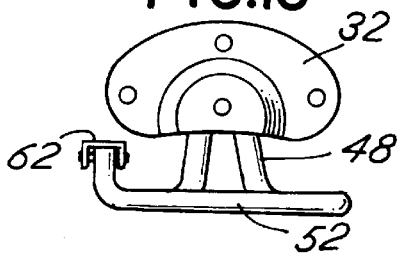
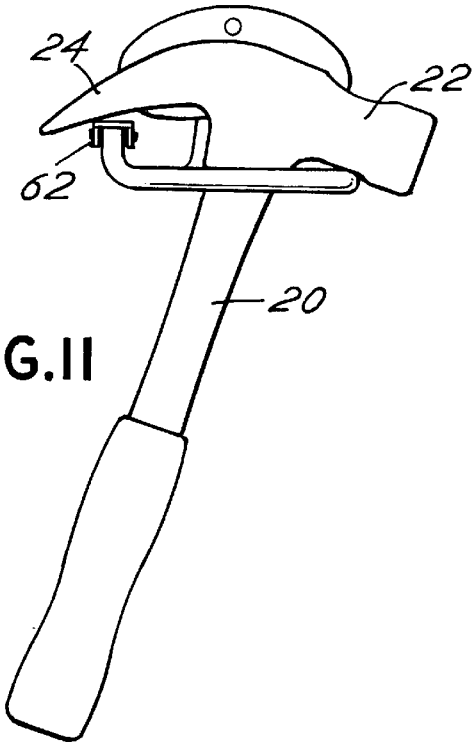
FIG.11

FIG.14
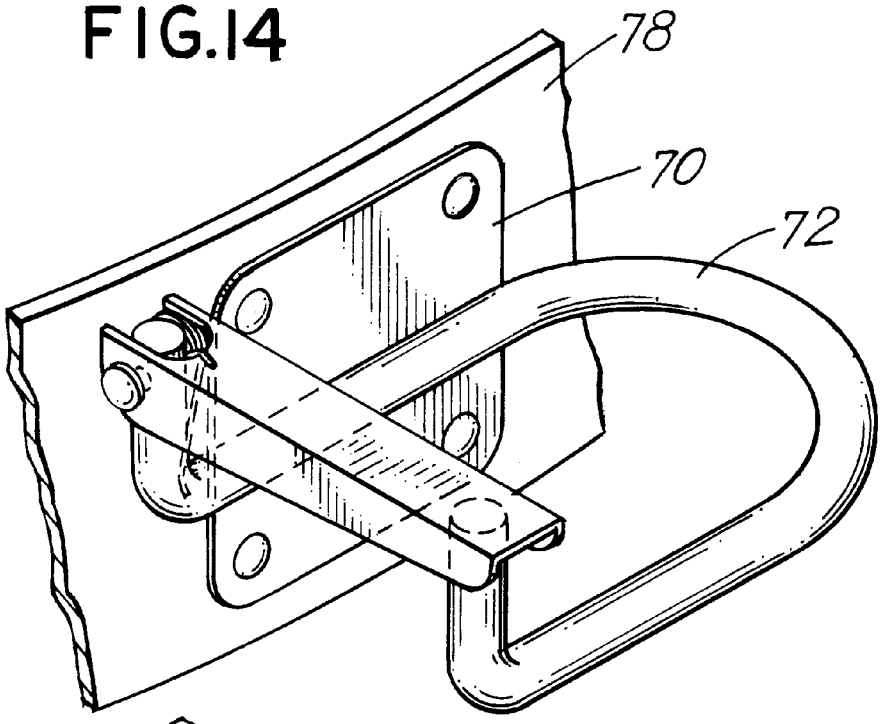
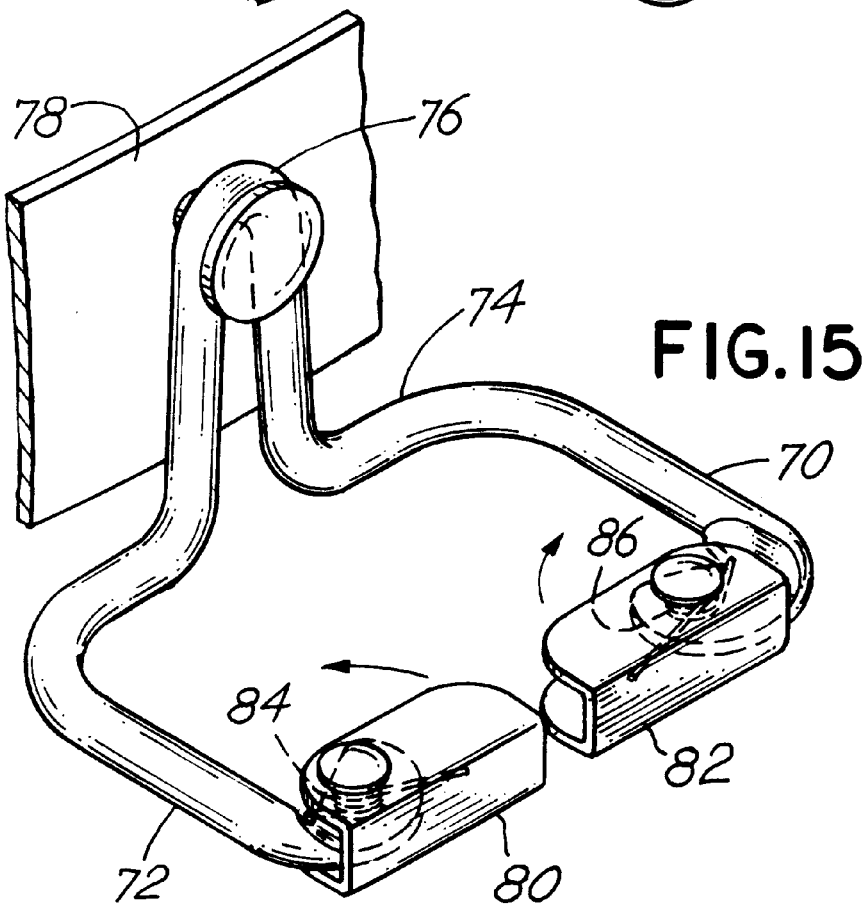
FIG.15

TOOL HOLDER FOR A TOOL BELT

BACKGROUND OF THE INVENTION

The present invention relates to a tool holder which may be used in combination with a worker's tool belt or the like.

Carpenters, utility persons, tradesmen, and other workers often attach a utility belt about their waist to hold their tools. The belt may include various pockets, hooks, loops and tool holders for holding tools such as pliers, hammers, etc. to permit easy access by the worker. Roofers, for example, typically use a hammer that may be retained in a loop on a tool belt. The hammer is retained by inserting the handle of the hammer through the belt loop with the head of the hammer being supported by the loop. In this manner, the hammer can be easily removed from the loop by lifting the hammer and then replaced in the loop as the next shingle or roofing element is positioned or while other tasks are performed.

On occasion, however, a tool storage loop will become entangled with the tool. Removal of the tool, e.g., a hammer, from the loop may thus be difficult. Consequently, a need for an improved means or mechanism for holding a hammer or similar tool by a tool belt has developed. This need inspired the development of the present invention.

SUMMARY OF THE INVENTION

In a principal aspect, the present invention comprises a tool holder which may be used in combination with a tool belt for holding a tool of the type having a head element and a handle element. The tool holder comprises a mounting plate which may be attached to the belt. A tool support member is attached to the plate. The support member defines a partial loop with spaced ends connectable by at least one biased, bridge element or bridge member to form a substantially closed loop. A tool such as a hammer having a head and a handle may then have the tool handle inserted through the loop with the tool head supported by the bridging element and the loop. The biased bridging element may be moved or pivoted out of position by engagement with the handle as the handle is lifted from the loop. The bridge element then moves back automatically into position to define a closed loop ready for insertion of the tool handle and support of the tool head.

Thus, it is an object of the invention to provide an improved tool holder for holding a tool of the type having a handle and a head wherein the tool may be easily removed from the holder.

A further object of the invention is to provide an improved tool holder useful in combination with a tool belt or utility belt.

Yet a further object of the invention is to provide an improved tool holder which includes a loop for support of the head of a tool and for insertion of a tool handle wherein the loop is mounted on a utility belt and wherein the loop includes a section which may be released by actuation of the handle, the section being spring biased into the position to normally close the loop.

Another object of the invention is to provide an improved tool holder for a utility belt or the like which is inexpensive, easy to attach to a utility belt, rugged and economical.

These and other objects, advantages and features of the invention will be set forth in the detailed description which follows.

BRIEF DESCRIPTION OF THE DRAWING

In the detailed description as follows, reference will be made to the drawing comprised of the following figures:

FIG. 8 is a plan view of the holder illustrating the manner in which the retaining loop may be oriented to hold the hammer;

FIG. 9 illustrates the manner in which a hammer is held by the tool holder in a configuration depicted in FIG. 8;

FIG. 10 illustrates the holder of the invention wherein the retaining loop is arranged in a generally horizontal configuration so as to hold a hammer;

FIG. 11 illustrates the manner in which a hammer is held by the configuration depicted in FIG. 10;

FIG. 12 illustrates a further possible orientation of the retaining loop associated with the tool holder of the invention;

FIG. 13 illustrates the manner in which a hammer is held in position on a tool belt by the tool holder in the configuration depicted by FIG. 12;

FIG. 14 is an isometric view of an alternative embodiment; and

FIG. 15 is an isometric view of another alternative embodiment of the invention.

DESCRIPTION OF THE PREFERRED EMBODIMENT

Figure 3:
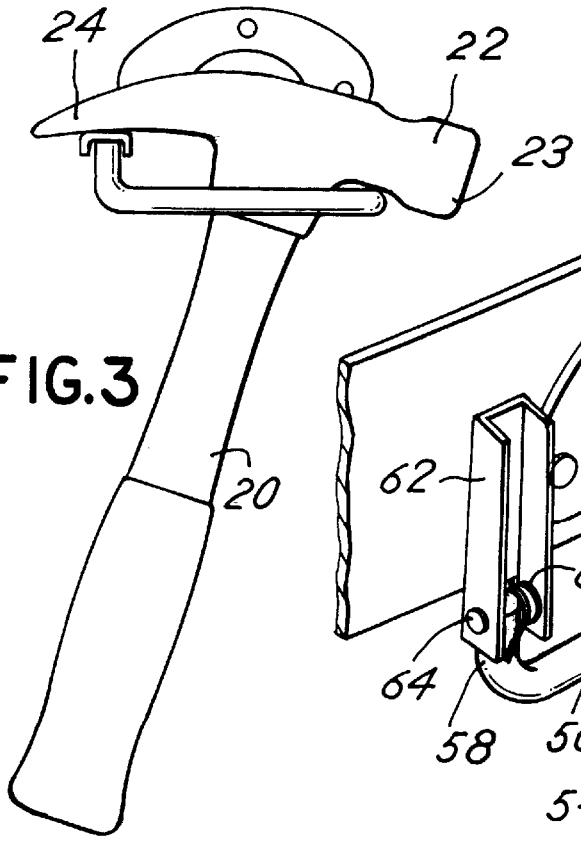
FIG. 3 is an elevation illustrated in the manner in which a tool such as a hammer is retained by the improved holder of the invention mounted on a tool belt.
Figure 4:
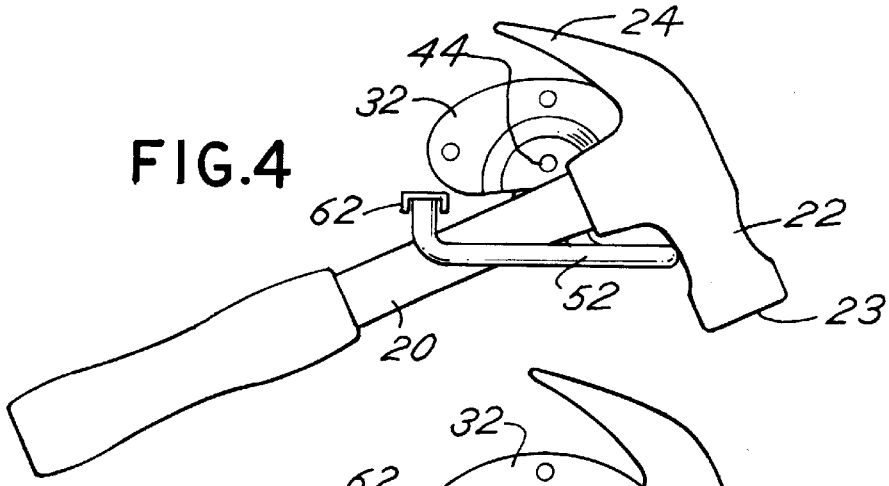
FIG. 4 is an elevation illustrating the manner in which a hammer may be manipulated in order to remove it easily from a holder of the invention.
Figure 5:
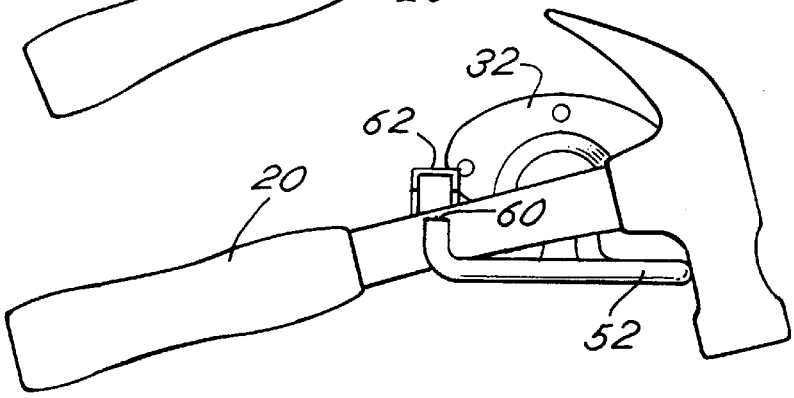
FIG. 5 illustrates further movement of the hammer and more particularly, the handle of the hammer to effect removal from the tool holder of the invention.
Figure 6:
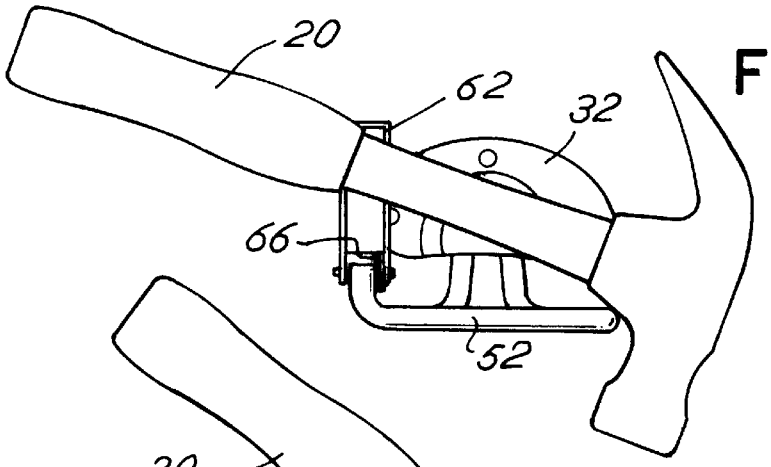
FIG. 6 illustrates in a plan view yet a further movement of the handle of the hammer in order to effect removal from the tool holder.
Figure 7:
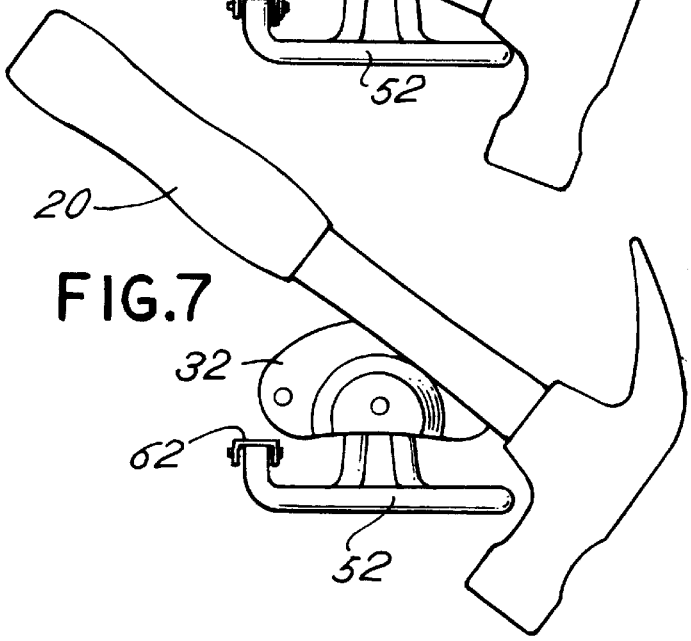
FIG. 7 is a further plan or elevation of the holder of the invention wherein the hammer head has been fully removed and the holder is reconfigured to receive the handle of the hammer.

The tool holder of the invention is constructed for retention of a hammer such as depicted in profile in FIG. 3. Thus, a hammer typically includes a handle 20 and a head 22. The head 22 includes an impact end 23 and a claw 24. It is noted that the tool holder of the invention may be used, however, for holding tools of various configuration and type. Thus, any tool which has a handle, such as handle 20 and a head, such as head 22, may be held by the tool holder of the invention. The particular configuration of the hammer or tool is thus not a limiting feature of the invention.

FIGS. 1 through 13 illustrate a first embodiment of the invention. Referring to FIGS. 1–13, the tool holder is typically mounted on a tool or utility belt 30. The holder thus includes a mounting plate 32 which is generally planar and includes rivets 34, 36 and 38 projecting therethrough to attach the plate 32 to the utility belt 30. The plate 32 further includes a semicylindrical land or ledge 40 and a semicircular plate 42 which together define a cavity through which a mounting pin 44 projects substantially at the center of the arc defining the semicylindrical or semicircular plate 42. The pin 44 retains a metal rod 46 which is shaped as a loop. Thus, the rod 46 includes a vertical, U-shaped section 48 which is retained by the pin 44. The U-shaped section 48 connects with a horizontal semicircular loop section 50 which, in turn, is connected to a generally horizontal run 52 and an upturned end 54. U-shaped section 48 extends in the opposite direction to define a run 56 generally spaced from and parallel to the run 52 and further includes an upturned end 58 which is spaced from the upturned end 54. The ends 54 and 58 are generally upstanding an equal length or dimension from their associated runs 52 and 56. The ends 54 and 58 terminate with a flat surface such as the surface 60. Runs 52 and 56 define the majority of a closed loop, i.e., at least about one half of a closed loop.

Figure 1:
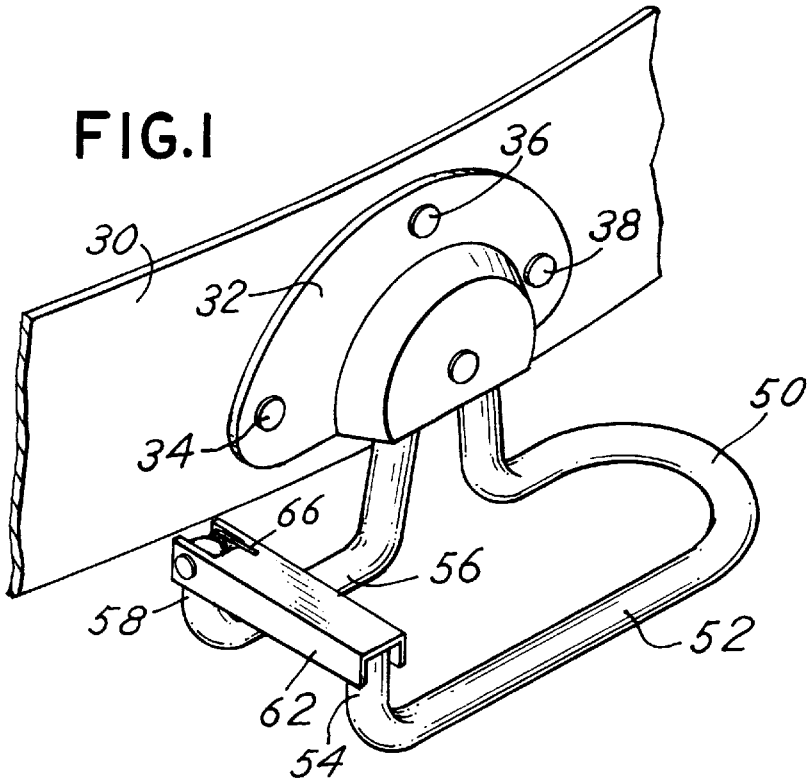
FIG. 1 is an isometric view of the tool holder of the invention in combination with a belt, such as a tool belt.
Figure 2:
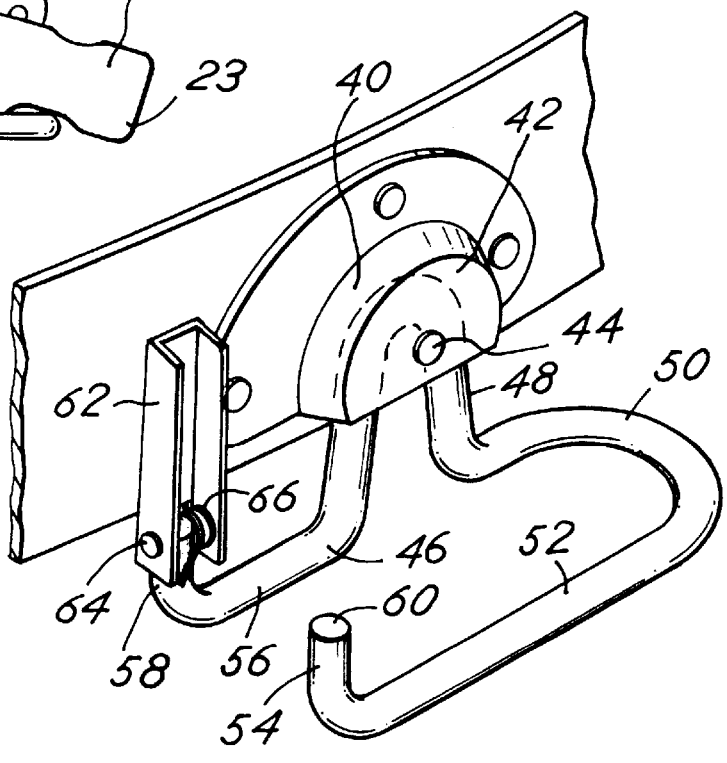
FIG. 2 is an isometric view similar to FIG. 1 wherein the retaining loop associated with the tool holder has a bridging section in the open position.

A bridge member 62 fits over the ends 54 and 58. The bridge member 62 is a U-shaped cross section channel which is affixed at one end to the upturned end 58 of the rod 46 by means of a pin 64. A spring 66 biases the U-shaped channel 62 to a closed position such as illustrated in FIG. 1 wherein the channel 62 bridges the gap between the spaced ends 54 and 58 and fits over the flat top surface, such as surface 60, of the ends 54 and 58. In this manner, a tool retention loop is defined by the rod 46 and bridge 62 as a closed loop where a portion of the loop is defined by straight bridge member 62. Straight side runs 52 and 56 which are parallel and spaced one from the other further define the loop. The loop is further defined by the generally semicircular section 50 which connects with the runs 52 and 56. In the configuration shown, the runs 52 and 54 are generally maintained in a horizontal orientation as is the bridge 62. This is illustrated in FIGS. 3–7, 10 and 11. However, the loop 46 may be canted about the pin 44 such as illustrated in FIGS. 8, 9, 12 and 13. In each circumstance, however, the head of the tool is appropriately maintained by the closed loop as illustrated for example in FIGS. 9, 11 and 13.

Removal of the tool, such as a hammer, is effected by grasping the handle such as handle 20 of the hammer and pivoting the handle 20 in a clockwise direction, such as illustrated in FIGS. 4–7 to cause the handle 20 to move upwardly and engage the bridge 62 causing the bridge 62 to pivot against the force of spring 66 and releasing the handle 20 from the loop. Note that the head 22 of the hammer engages against the semicircular section 50 of the loop and permits the handle 20 to be pivoted through the bridge 62 for easy removal in a step wise manner as depicted in FIGS. 4–7. Such step wise removal is effected, as indicated, by moving the handle 20 in a clockwise direction to release the handle 20 from the loop by pivoting the bridge 62 out of position.

To reposition the tool, such as the hammer, within the tool retainer device, the handle 20 is merely slipped through the loop defined by the rod 46 and bridge 62. The handle is then retained as illustrated in FIGS. 3, 9, 11 and 13.

As shown in FIG. 14, the holder may have a planar plate 71 with a loop 73 welded thereto. FIG. 15 illustrates another alternative embodiment. A partial tool support loop is defined by horizontal, parallel, spaced legs 71 and 73 which extend from a connecting element 74. Element 74 includes a U-shaped section 76 held on plate 78 by a pin or welding, for example. First and second bridging elements 80, 82 are pivotally attached to legs 70, 72, respectively, and are normally biased to form a substantially closed loop. The bridging elements 80, 82 are biased by coil springs 84, 86 to the closed loop position depicted in FIG. 15, but may be pivoted inwardly to the planar position shown in FIG. 15 by engagement with a hammer handle, for example. In section of the handle (not shown) into the loop is thus effected and the bridging elements will then close to define a mechanism for holding the handle in a stored condition until it is lifted from the closed loop. Thus, various alternative designs of the loop and the plate are possible.

It is possible to vary the configuration of the loop by redefining the shape of the rod 46 with defining the loop and by redefining the shape and extent of the bridge, for example. Various other changes to the construction may also be effected without departing from the scope of the invention. Thus, the invention is to be limited only by the following claims and equivalents thereof.

I claim:

1. A tool holder for a tool of the type having a head element and a handle element, said holder comprising, in combination:

a mounting plate for attachment to a support;

a tool head element support member attached to the mounting plate, said tool head element support member including a first loop extension and a second loop extension, said loop extensions being coplanar and defining the majority of a closed loop for enclosing a handle element, said extensions terminating at first and second, spaced ends, said ends each being upturned to expose a flat support surface;

a bridge member attached to one of the spaced ends and projecting over and against the surface of the other end to define a closed loop, said loop providing an enclosure and a support for a tool head element resting on the loop, said tool handle element projecting through the loop, said bridge member pivotal from the second end to open the loop for removal of the handle between the spaced ends.

2. The holder of claim 1 including a biasing element for biasing the bridge member to a closed loop position.

3. The holder of claim 1 in combination with a tool belt support, said plate attached to the belt support.

4. The holder of claim 1 wherein the tool head element support member comprises a rod.

5. The holder of claim 4 wherein the rod first loop extension comprises a semicircular run and a connected straight run terminating at the first end, and wherein the rod second loop extension comprises a second straight run generally parallel to the first run and terminating at the second end.

6. The holder of claim 1 wherein the tool support head element and bridge member are generally horizontal.

7. The holder of claim 1 wherein the tool support head element is pivotally attached to the mounting plate.

8. The holder of claim 1 wherein the bridge member comprises a channel member including spaced sides and a crown, said channel member being fitted over the first and second ends.

9. A tool belt including a tool holder for a tool having a handle and a head comprising, in combination:

a belt comprising a support;

a plate attached to the belt;

a partially open loop member attached to the plate, said loop member defining at least two coplanar sides of an enclosure for a handle and having opposite, spaced ends, said ends being upturned to expose two flat upwardly facing surfaces;

a bridge member connected to one of the ends and positionable to close the loop by fitting against the surface of the other end, said loop comprising means to support a tool head and receive a tool handle, said bridge member including biasing means for biasing the bridge member to close the loop, said bridge member being pivotal to open the loop and permit removal of the handle between the spaced ends.

10. The belt of claim 9 wherein the loop member is pivotally attached to the plate and movable about a generally horizontal axis and said loop is generally perpendicular to the plate.

* * * * *